US008220477B2

(12) United States Patent
Park

(10) Patent No.: US 8,220,477 B2
(45) Date of Patent: Jul. 17, 2012

(54) CANOPY FRAME

(75) Inventor: Lindy Park, Yorba Linda, CA (US)

(73) Assignee: Caravan Canopy International, Inc., La Mirada, CA (US)

( * ) Notice: Subject to any disclaimer, the term of this patent is extended or adjusted under 35 U.S.C. 154(b) by 33 days.

(21) Appl. No.: 12/534,088

(22) Filed: Jul. 31, 2009

(65) Prior Publication Data

US 2011/0023924 A1 Feb. 3, 2011

(51) Int. Cl.
*E04H 15/50* (2006.01)

(52) U.S. Cl. ..... 135/145; 135/131

(58) Field of Classification Search ..... 135/131, 135/139, 141, 145, 147
See application file for complete search history.

(56) References Cited

U.S. PATENT DOCUMENTS 4,779,635 A 10/1988 Lynch
4,885,891 A 12/1989 Lynch
4,947,884 A 8/1990 Lynch
5,244,001 A 9/1993 Lynch
5,421,356 A 6/1995 Lynch
5,490,532 A 2/1996 Mallookis et al.
5,711,337 A 1/1998 McKenney
5,794,640 A * 8/1998 Jang ..... 135/131
5,944,040 A 8/1999 Jang
6,035,877 A * 3/2000 Losi et al. ..... 135/131
6,112,757 A 9/2000 Tseng
6,138,702 A 10/2000 Carter
6,206,020 B1 3/2001 Lynch
6,397,872 B1 6/2002 Carter
6,439,251 B2 8/2002 Carter
6,470,902 B1 10/2002 Carter
6,502,597 B2 1/2003 Carter
6,598,614 B2 7/2003 Liu
6,666,223 B2 12/2003 Price et al.
6,708,707 B2 3/2004 Dotterweich et al.
6,718,995 B2 4/2004 Dotterweich
6,725,873 B2 4/2004 Liu
6,766,623 B1 7/2004 Kalnay
6,779,538 B2 8/2004 Morgante et al.
6,866,055 B2 3/2005 Scherer
6,868,858 B2 3/2005 Suh
6,874,519 B2 4/2005 Chiang
6,874,520 B2 4/2005 Carter
6,929,017 B2 8/2005 Byun
6,951,327 B1 10/2005 Seo
6,996,941 B1 2/2006 Maschoff
7,025,075 B2 4/2006 Suh
7,178,539 B2 2/2007 Patel et al.
7,240,686 B2 7/2007 Seo
7,252,108 B2 8/2007 Carter
7,299,813 B2 * 11/2007 Ochi ..... 135/145
7,308,901 B2 12/2007 Meyer
7,311,113 B2 12/2007 Suh
7,350,532 B2 4/2008 Wu (Continued)

*Primary Examiner* — David Dunn
*Assistant Examiner* — Danielle Jackson
(74) *Attorney, Agent, or Firm* — Christie, Parker & Hale, LLP

(57) ABSTRACT

A collapsible canopy frame having an improved roof and support structure. A collapsible canopy frame according to one embodiment includes a plurality of side poles; a plurality of edge scissor assemblies coupling adjacent side poles of the plurality of side poles to one another; a center pole for supporting a covering; a plurality of center pole ribs each coupling the center pole to a respective side pole of the plurality of side poles; and a plurality of center scissor assemblies coupling the plurality of edge scissor assemblies to the center pole.

16 Claims, 7 Drawing Sheets

U.S. PATENT DOCUMENTS

| | | | | |
|---|---|---|---|---|
| 7,360,549 | B2 | 4/2008 | Seo | |
| 7,409,963 | B2 | 8/2008 | Mallookis et al. | |
| 7,422,026 | B2 * | 9/2008 | Kim | 135/131 |
| 7,428,908 | B2 | 9/2008 | Seo | |
| RE40,544 | E | 10/2008 | Suh | |
| 7,448,400 | B2 | 11/2008 | Jensen | |
| 2005/0155637 | A1 * | 7/2005 | Kim | 135/131 |
| 2008/0066795 | A1 * | 3/2008 | Sy-Facunda | 135/145 |

* cited by examiner

CANOPY FRAME

FIELD OF THE INVENTION

The present invention relates to a collapsible canopy frame, and more particularly to a collapsible canopy frame having an improved roof and support structure.

BACKGROUND

Typical collapsible canopy frames often include a plurality of telescoping legs, each having one or more X-shaped connectors to form scissor assemblies extending between the telescoping legs along the perimeter of the frame. The X-shaped scissor assemblies are movable relative to the telescoping legs to adjust the collapsible canopy frame between an expanded position and a collapsed position. In the expanded position, the collapsible canopy frame provides a temporary shelter. In the collapsed position, the collapsible canopy frame can be more readily transported. A variation of the typical scissor assembly canopy frame includes additional center scissor assemblies coupled between edge scissor assemblies and a center post. The center scissor assemblies are made using X-shaped connectors in a manner similar to how the edge scissor assemblies are constructed.

In a typical collapsible canopy, a canopy covering such as a cloth or leather covering is disposed above, and supported by, the collapsible canopy frame. Many typical frames also have a central support member that supports the canopy covering, creating a triangular or pyramidal shape. For example, in the typical scissor assembly canopy frame described above, the frame may include a central support member. At the same time as the scissor assemblies are expanded, the central support member is raised into a vertical supporting position and has an extendable vertical pole member that is used to support a canopy and provide a peak for the canopy. However, substantial sagging of the canopy covering is typical of canopy frames with only a single central support member. Therefore, there is a need for a roof structure that fully supports a canopy covering and keeps it tautly stretched over the canopy frame.

Alternative collapsible canopy frames employ a cathedral-style roof structure having a plurality of ribs, each coupled to a telescoping leg on one end and to a central support member on the other end. Each rib may consist of a single rib member or a scissor assembly. In some canopy frames, the ribs are reinforced by support members coupled between each rib and a corresponding telescoping leg. However, many canopy frames employing a cathedral-style roof structure are relatively unstable and flimsy, which means that these structures tend to collapse in strong winds or otherwise must have lowered profiles.

Accordingly, a need exists for a collapsible canopy frame that both maintains a tautly stretched canopy covering and provides a strong and stable foundation for the canopy.

SUMMARY OF THE INVENTION

Embodiments of the present invention are directed to a collapsible canopy frame having an improved roof and support structure, including a cathedral-style roof and a plurality of edge and center scissor assemblies.

In one embodiment, a collapsible canopy frame includes a plurality of side poles; a plurality of edge scissor assemblies coupling adjacent side poles of the plurality of side poles to one another; a center pole for supporting a covering; a plurality of center pole ribs each coupling the center pole to a respective side pole of the plurality of side poles; and a plurality of center scissor assemblies coupling the plurality of edge scissor assemblies to the center pole.

The edge scissor assemblies and center scissor assemblies may include two scissor members pivotably coupled together at a hinged joint. The center scissor assemblies may be coupled at one end to a corresponding one of the edge scissor assemblies and to the center pole at the other end. In one embodiment the collapsible canopy frame may include a plurality of support members coupled between center pole ribs of the plurality of center pole ribs and respective side poles of the plurality of side poles.

In another embodiment, a collapsible canopy frame includes a plurality of side poles; a plurality of edge scissor assemblies coupling adjacent side poles of the plurality of side poles to one another; a center pole for supporting a covering; a plurality of center pole ribs each coupling the center pole to a respective side pole of the plurality of side poles; a plurality of center scissor assemblies coupling the plurality of edge scissor assemblies to the center pole; a first hub near an upper end of the center pole and coupling the plurality of center pole ribs to the center pole; a second hub coupling a plurality of first scissor members of the plurality of center scissor assemblies to the center pole; and a third hub between the first hub and the second hub and coupling a plurality of second scissor members of the plurality of center scissor assemblies to the center pole, the third hub slidable along the center pole.

Other features and advantages of embodiments of the present invention will become apparent from the following detailed description, taken in conjunction with the accompanying drawings which illustrate, by way of example, the features of the present invention.

DETAILED DESCRIPTION

Figure 1:
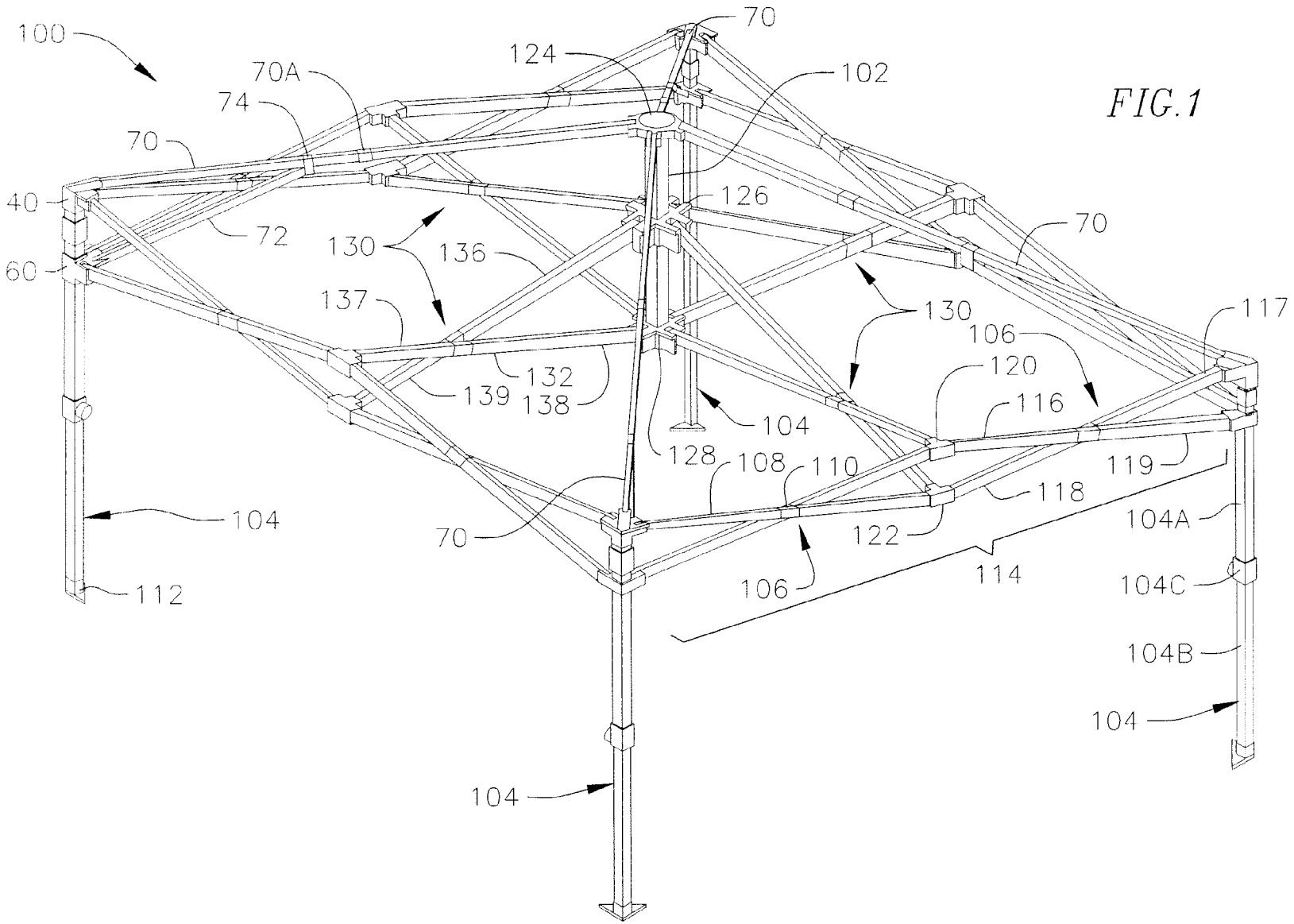
FIG. 1 is a perspective view of a canopy frame according to an exemplary embodiment of the present invention.

In the following detailed description, certain exemplary embodiments of the present invention are shown and described, by way of illustration. As those skilled in the art would recognize, the described exemplary embodiments may be modified in various ways without departing from the spirit and scope of the present invention. Accordingly, the drawing and description are to be regarded as illustrative in nature, rather than restrictive.

As shown in the drawings, embodiments of a collapsible canopy frame according to the present invention have an improved roof and support structure including a cathedral-style roof structure and a plurality of intercoupled edge and center scissor assemblies.

With reference to FIG. 1, a collapsible canopy frame 100 according to one exemplary embodiment of the present invention includes a center pole 102, telescoping side poles 104 and edge scissor assemblies 106 that intercouple each pair of adjacent side poles 104. Each of the edge scissor assemblies 106 is formed of a pair of scissor members 108 coupled together and rotatable about a pivot 110. In one exemplary embodiment, the canopy frame 100 further includes a plurality of center scissor assemblies 130 and a plurality of center pole ribs 70. Each of the center scissor assemblies 130 is formed of a pair of scissor members 132 pivotably coupled together at a hinged joint.

In one embodiment, each telescoping side pole 104 has a substantially square cross-section and a foot bracket 112 attached at a bottom end of the side pole 104 for supporting the weight of the collapsible canopy frame 100. Canopy frames according to other embodiments of the present invention may include greater or fewer than four side poles.

In one embodiment, the side poles 104 of each pair of adjacent side poles 104 are intercoupled to each other through a set 114 of two edge scissor assemblies 106. In other embodiments, the set 114 may include more than two intercoupled edge scissor assemblies 106. The edge scissor assemblies 106 of set 114 are pivotably coupled to respective side poles 104 and to each other. Upper and lower inner ends 116, 118 of each edge scissor assembly 106 are pivotably coupled to respective upper and lower inner ends 116, 118 of another edge scissor assembly 106 of the same set 114 via upper and lower coupling brackets 120 and 122.

Center pole 102 is configured to support a canopy covering (not shown) at the center of the canopy frame 100. In one exemplary embodiment, near the top of the center pole 102 is a first hub 124, which couples a plurality of center pole ribs 70 to the center pole 102. The center pole 102 also has mounted thereon a second hub 126 and a third hub 128. The second hub 126 couples upper inner ends 136 of center scissor assemblies 130 to the center pole 102 and the third hub 128 couples lower inner ends 138 of the center scissor assemblies 130 to the center pole 102. In one exemplary embodiment, the second hub 126 is positioned on the center pole 102 between the first hub 124 and the third hub 128. In one embodiment, the second hub 126 is movable with respect to the center pole 102 while the third hub 128 is substantially stationary with respect to the center pole 102.

In one embodiment, each telescoping side pole 104 includes two telescoping sections 104A and 104B, which correspond to upper and lower sections, respectively. The upper and lower sections 104A and 104B are coupled to each other through a height adjustment bracket 104C, which adjusts the relative positions of the upper and lower sections 104A and 104B and therefore the height of each telescoping side pole 104. In other embodiments, the side poles may not be telescoping, and instead may have a fixed length.

In one exemplary embodiment, each telescoping side pole 104 has a first bracket 40 and a second bracket 60 mounted thereon. Each of the first brackets 40 couples one of the center pole ribs 70 to a corresponding one of the side poles 104. In one exemplary embodiment, the first bracket 40 is positioned above the second bracket 60 near the top of the side pole 104 and is stationary while the second bracket 60 is movable with respect to the side pole 104. Alternatively, the first bracket 40 may be positioned below the second bracket 60 on the side pole 104. At each corner of the canopy frame 100, upper outer ends 117 of the edge scissor assemblies 106 are pivotably coupled to one of the side poles 104 via the first bracket 40. Lower outer ends 119 of the edge scissor assemblies 106 are pivotably coupled to a corresponding side pole 104 via second bracket 60.

In one exemplary embodiment, the canopy frame 100 further includes the center scissor assemblies 130. Each center scissor assembly 130 can be formed by pivotably coupling a pair of scissor members 132 about their respective centers. In other embodiments, the pair of scissor members may be coupled together at a point other than their respective centers. In one embodiment, center scissor assembly 130 has substantially the same structure as edge scissor assembly 106. Each of center scissor assemblies 130 is pivotably coupled between the center pole 102 and a corresponding set 114 of edge scissor assemblies 106. In some embodiments, two or more center scissor assemblies 130 may be intercoupled between the center pole 102 and a corresponding set 114 of edge scissor assemblies 106.

In more detail, each center scissor assembly 130 is pivotably coupled between the upper and lower coupling brackets 120, 122 of the set 114 of edge scissor assemblies 106 and the second and third hubs 126, 128 of the center pole 102. FIG. 1 shows four center scissor assemblies 130, but other embodiments may include greater or fewer than four center scissor assemblies 130. In addition, in FIG. 1 the center scissor assemblies 130 are coupled to a corresponding set 114 of edge scissor assemblies 106 at approximately a midpoint of the set 114. However, in other embodiments, they may be coupled to a set 114 at a location other than the midpoint. In one embodiment, the plurality of center scissor assemblies 130 may be positioned along a single horizontal plane. In other embodiments, the center scissor assemblies 130 may be positioned at an upwards angle from a horizontal plane.

In addition to the center scissor assemblies 130, in one exemplary embodiment the canopy frame 100 further includes a plurality of center pole ribs 70. As shown in FIG. 1, each center pole rib 70 couples the center pole 102 to a respective side pole 104 and is oriented to point towards the center of the frame where the first hub 124 is located. In one embodiment, one end of the center pole rib 70 is pivotably coupled to a pole coupling member 44 (shown in FIGS. 4 and 5) located on a top surface of the first bracket 40, while the other end of center pole rib 70 is pivotably coupled to the first hub 124. In one embodiment, the center pole ribs 70 are collapsible at joints 70A.

In one exemplary embodiment, a plurality of support members 72 is provided to support and reinforce the center pole ribs 70 when the canopy frame is an expanded state as shown in FIG. 1. Support members 72 are coupled between center pole ribs 70 and respective side poles 104. One end of the support member 72 is pivotably coupled to move with second bracket 60 along side pole 104 and the other end is pivotably coupled to center pole rib 70 at pole joint 74. According to one exemplary embodiment, each center pole rib 70 and support member 72 can fold and unfold along with the rest of the canopy frame 100.

Figure 2:
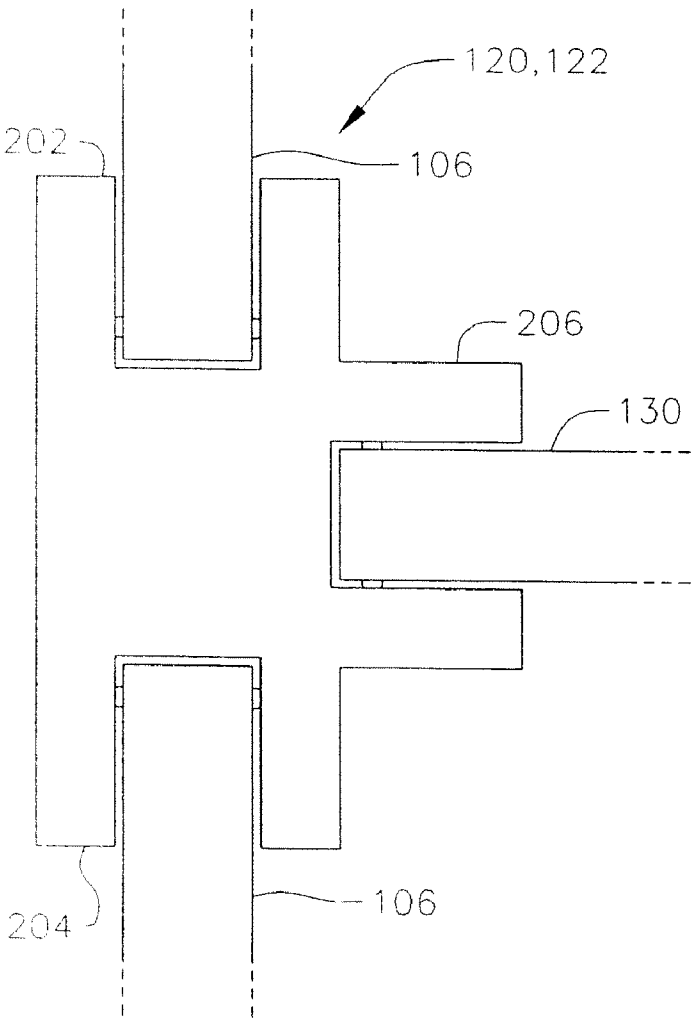
FIG. 2 is a top view of a connecting bracket of the canopy frame of FIG. 1.

Referring now to FIGS. 1 and 2, each of the upper and lower coupling brackets 120 and 122 has three coupling members 202, 204, and 206. The coupling members 202, 204, and 206 may be of the same or different shapes. The coupling members 202 and 204 face at substantially 180 degrees of each other, and are used to pivotably couple the edge scissor assemblies 106 of the same set 114 to each other. Specifically, upper coupling bracket 120 intercouples the upper inner ends 116 of edge scissor assemblies 106 in the same set 114. Lower coupling bracket 122 intercouples the lower inner ends 118 of edge scissor assemblies 106 in the same set 114. The coupling member 206 of each bracket faces at substantially a right angle with respect to each of the two 180-degree apart coupling members 202 and 204, and is used to pivotably couple the outer ends 137, 139 of center scissor assemblies 130 to a respective set 114 of edge scissor assemblies 106.

Figure 3:
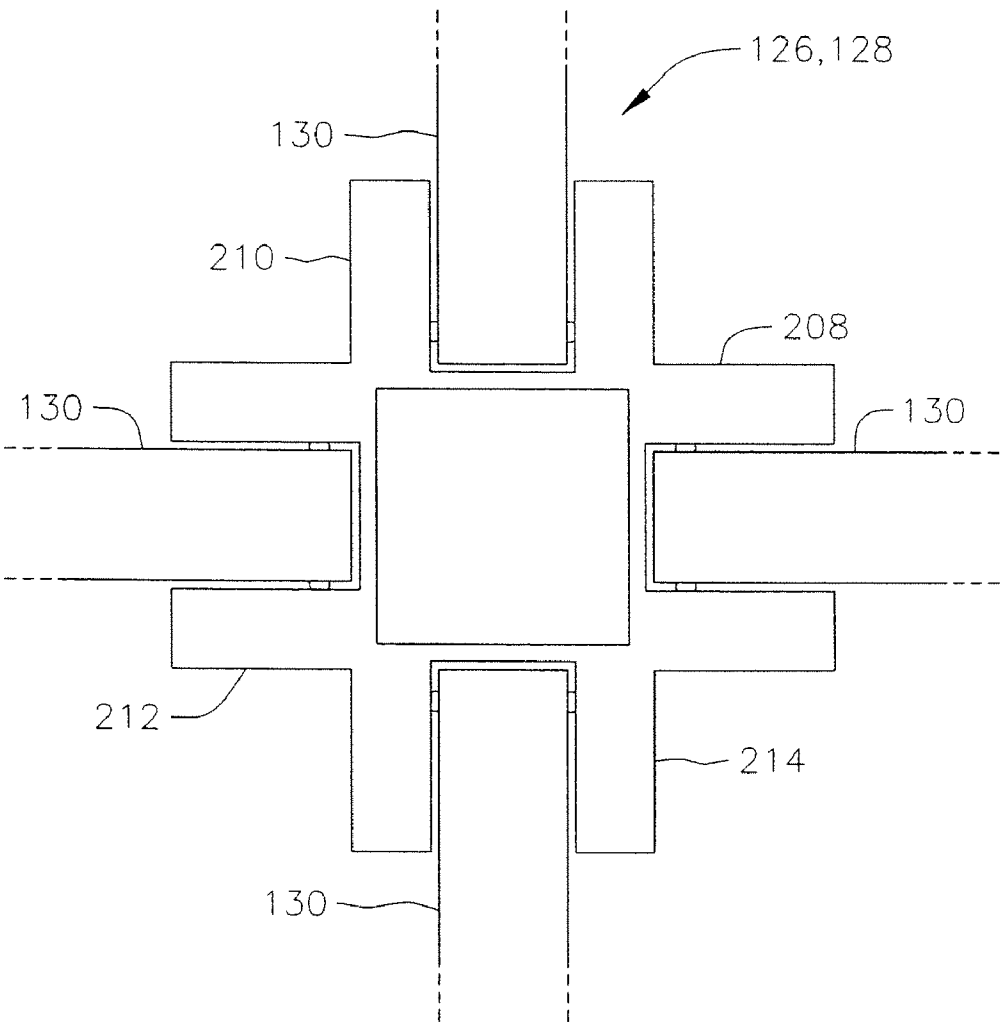
FIG. 3 is a top view of a hub of the canopy frame of FIG. 1.

Referring now to FIGS. 1 and 3, each of the second and third hubs 126 and 128 of center pole 102 has four coupling members 208, 210, 212, and 214, each facing one set 114 of edge scissor assemblies 106. The coupling members 208, 210, 212, and 214 may be of the same or different shapes. The second and third hubs 126 and 128 are pivotably coupled to four different center scissor assemblies 130 that extend from the second and third hubs 126 and 128 at approximately 90 degrees apart from one other. Hence, each center scissor assembly 130 is pivotably coupled between the center pole 102 and a corresponding set 114 of edge scissor assemblies 106. Alternatively, the second and third hubs 126 and 128 may include greater or fewer than four connecting members to pivotably couple any number of center scissor assemblies 130 at any desired angle apart from one another.

Figure 4:
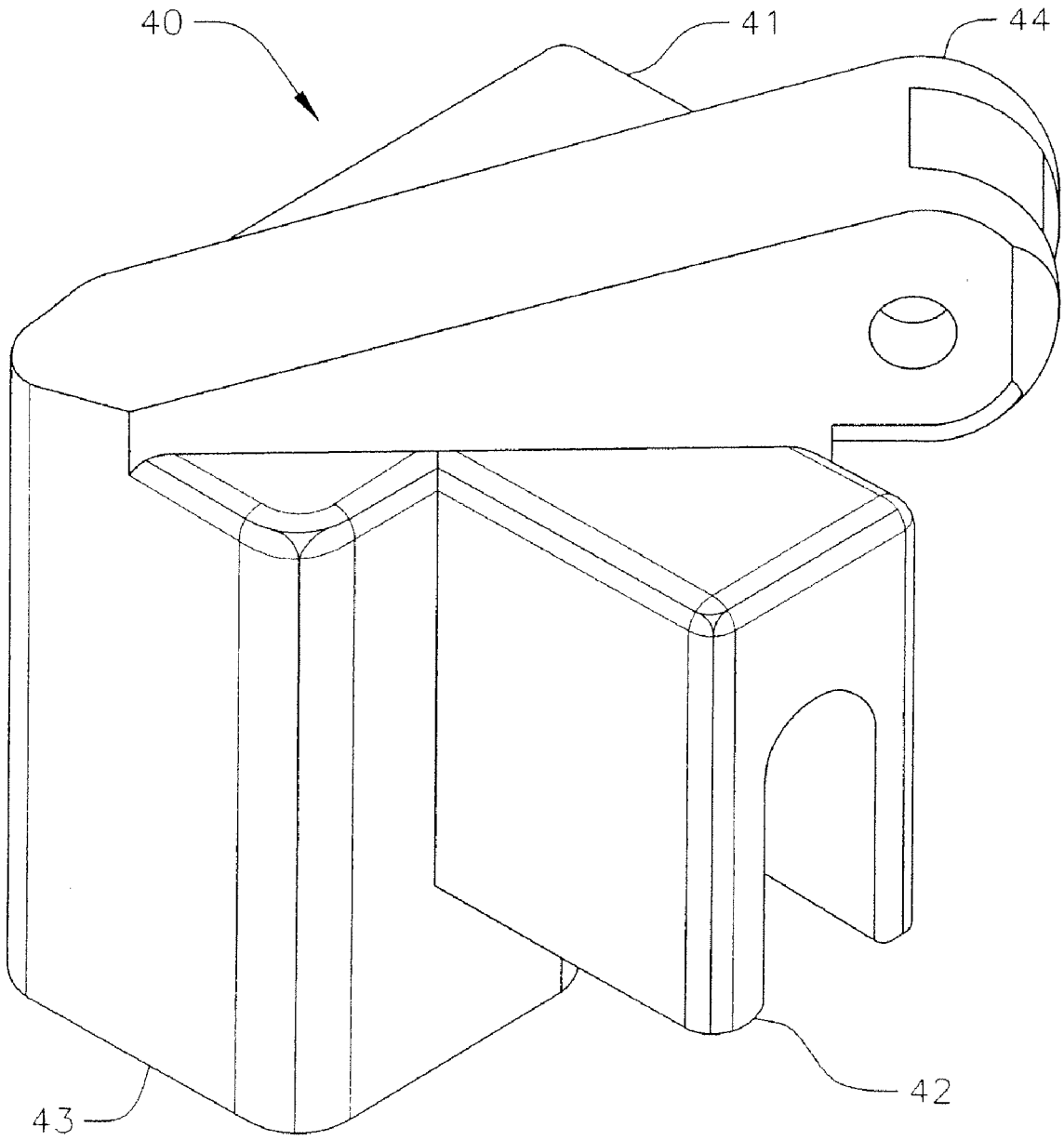
FIG. 4 is a perspective view of a first bracket of the canopy frame of FIG. 1.
Figure 5:
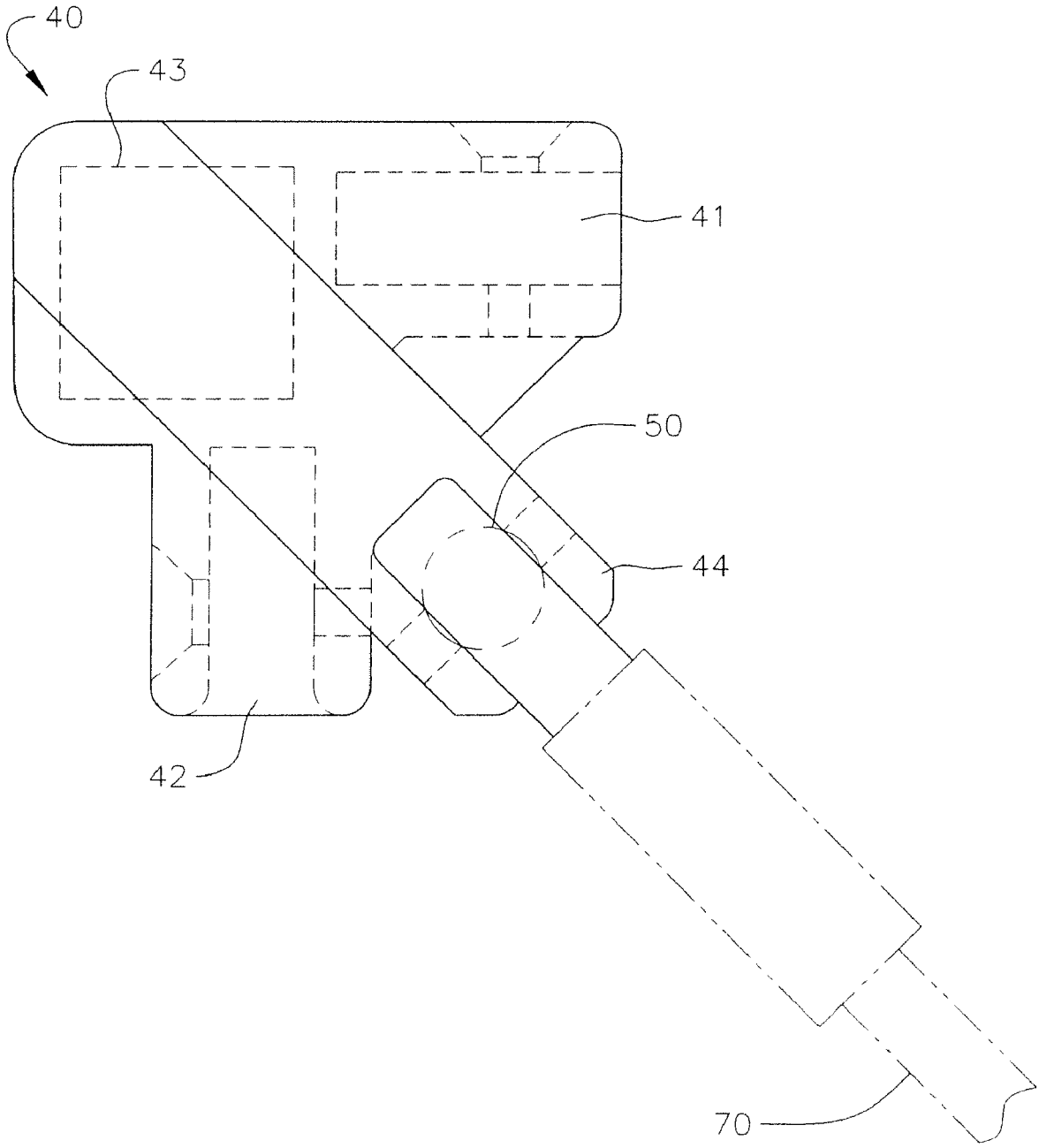
FIG. 5 is a top view of the first bracket of FIG. 4.

FIGS. 4 and 5 show the structure of each first bracket 40 according to one embodiment, which has a cavity 43 for receiving a side pole 104, supporting member portions 41 and 42 for receiving and pivotably coupling to upper outer ends 117 of edge scissor assemblies 106 at a corner of the canopy frame 100, and a pole coupling member 44 disposed on a top surface of the first bracket 40 and configured to pivotably couple to one of the center pole ribs 70. In some embodiments a spherical movable member 50 may be disposed on the end of center pole rib 70 to pivotably couple it to the pole coupling member 44. In other embodiments, the components described above may be pivotable relative to one another via pins or any other suitable devices or combination thereof.

Figure 6:
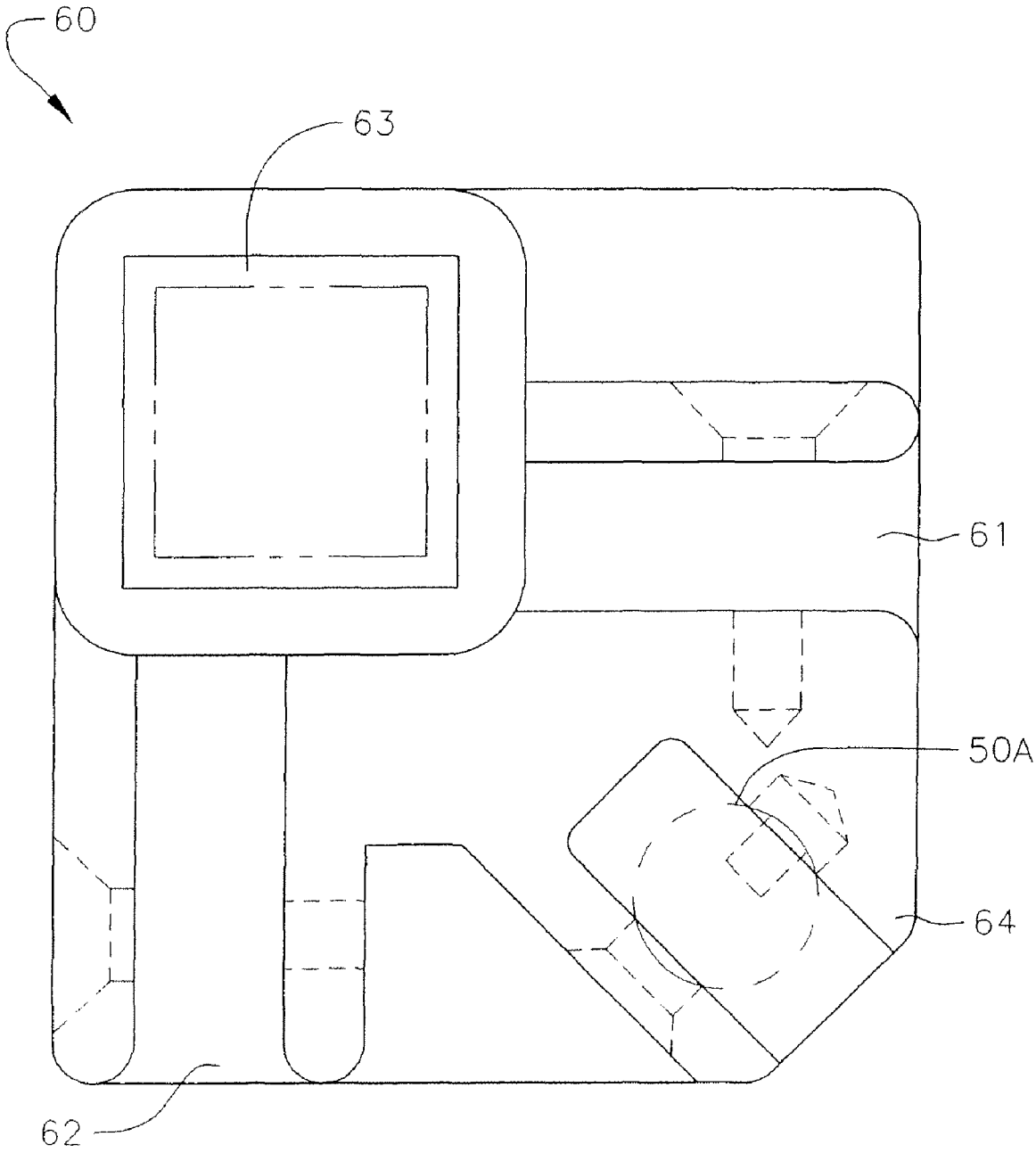
FIG. 6 is a top view of a second bracket of the canopy frame of FIG. 1.

FIG. 6 shows the structure of each second bracket 60 according to one embodiment, which has a cavity 63 through which a side pole 104 passes, supporting member portions 61 and 62 for receiving and pivotably coupling to lower outer ends 119 of edge scissor assemblies 106 at a corner of the canopy frame 100, and a support member coupling member 64 configured to pivotably couple to one of the support members 72. In some embodiments, a spherical movable member 50A may be disposed on the end of support member 72 to pivotably couple it to the pole coupling member 64. In other embodiments, the components described above may be pivotable relative to one another via pins or any other suitable devices or combination thereof.

Figure 7:
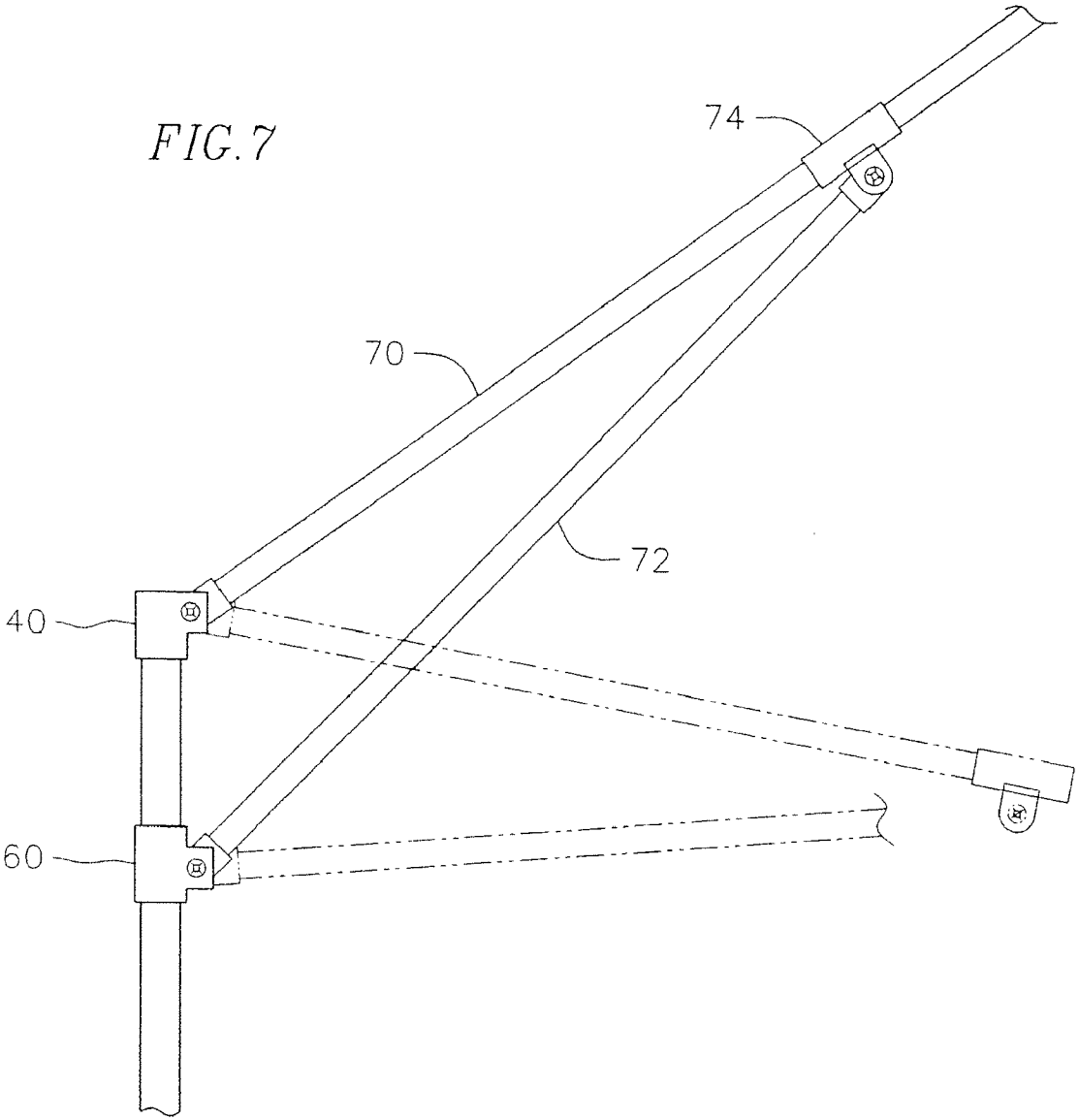
FIG. 7 is a frontal view of a support member of the canopy frame of FIG. 1.

FIG. 7 shows a frontal view of a support member 72 coupled between a side pole 104 and a corresponding center pole rib 70 according to an embodiment of the present invention. One end of support member 72 is pivotably coupled to move with the second bracket 60, and the other end of support member 72 is pivotably coupled to center pole rib 70 by a pole joint 74. In one exemplary embodiment, each support member 72 can fold and unfold along with the canopy frame 100. In some embodiments, support member 72 consists of a single rib member that may be curved or linear in shape when fully expanded. In some embodiments, center pole rib 70 consists of a single rib member that may be curved or linear in shape when fully expanded. Alternatively, center pole rib 70 may comprise a scissor assembly. Also, a canopy frame according to other embodiments of the present invention may include the center pole ribs 70 without the support members 72.

Figure 8:
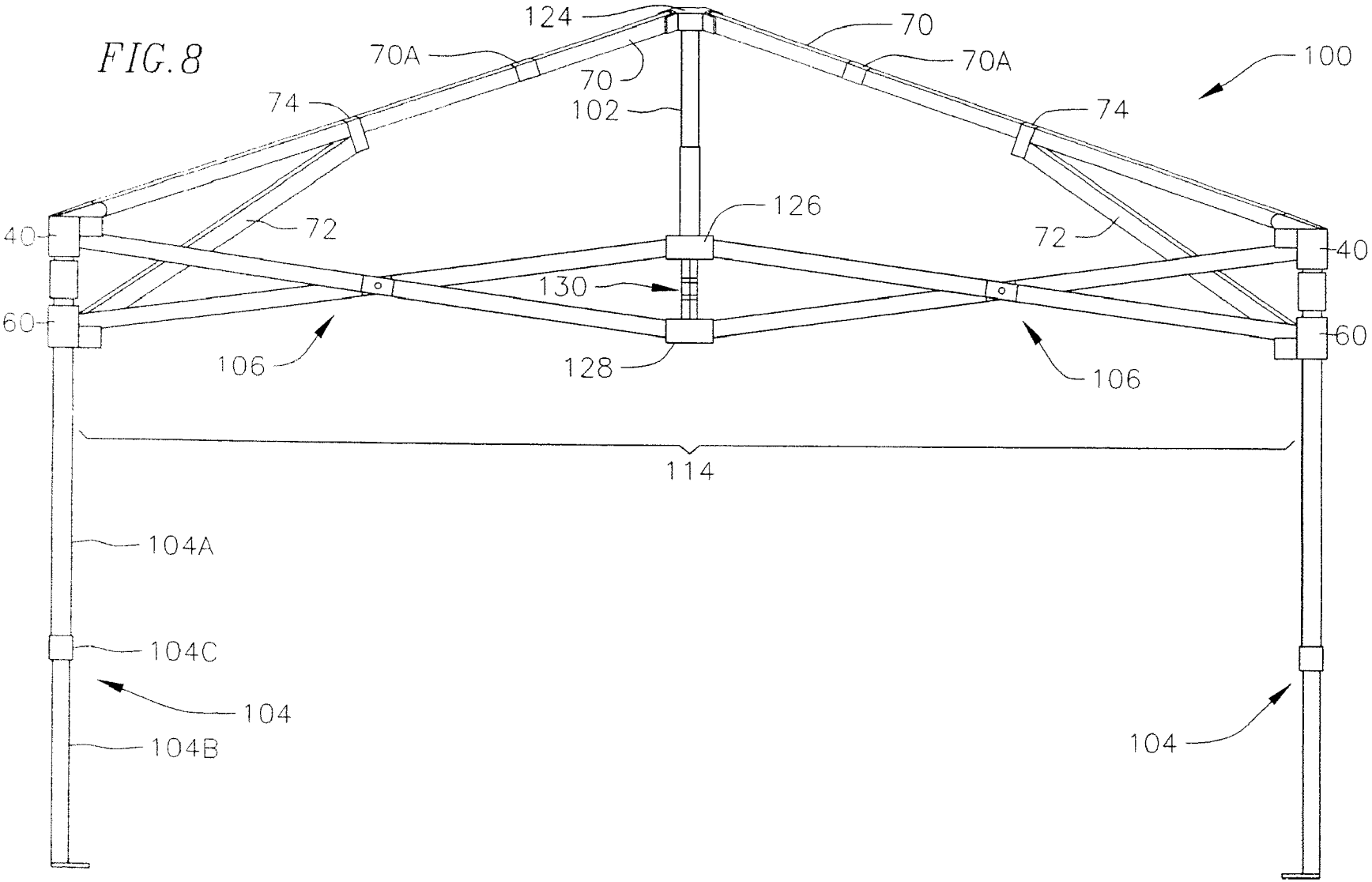
FIG. 8 is a side view of the canopy frame of FIG. 1.

FIG. 8 shows a side view of the canopy frame 100 of FIG. 1, including side poles 104, a set 114 of edge scissor assemblies 106 coupled to the center pole 102 at second and third hubs 126 and 128, and center pole ribs 70 collapsible at joints 70A and coupled to corresponding side poles 104 at a first bracket 40. The support members 72 are coupled at one end to the side pole 104 at a second bracket 60 and to the center pole rib 70 at joint hinge 74. The center pole ribs 70 are each coupled to the center pole 102 at first hub 124.

FIGS. 1 and 8 illustrate the collapsible canopy frame 100 in a fully opened position. In one embodiment, to expand the canopy frame 100 from a collapsed state to the fully opened state shown in FIGS. 1 and 8, the side poles 104 are pulled outwardly at the same time, stretching the canopy frame 100. As the side poles 104 are pushed outwardly, the second brackets 60 move upward along the side poles 104 while scissor members 108 and 132 rotate relative to one another to reduce the distance between their respective ends, elongating the edge and center scissor assemblies 106 and 130. As the second brackets 60 move upwardly along side poles 104, support members 72 coupled to move with second brackets 60 also move upwardly and push the center pole ribs 70 upward. As the center pole ribs 70 are pushed upwardly, the center pole 102 is moved into a vertical supporting position for tautly supporting a canopy covering.

To collapse the canopy frame 100, the side poles 104 are pushed towards the center of the frame, forcing second brackets 60 to move away from first brackets 40 as scissor members 108 and 132 are rotated relative to one another to increase the distance between their respective ends. Meanwhile, each of the second brackets 60 moves downward along the upper section 104A of the side pole 104 towards the height adjustment bracket 104C and away from the first bracket 40. As the second bracket 60 moves downwardly, the joint hinge 74 moves down the center pole rib 70 towards the first bracket 40, such that the support members 72 coupled to side poles 104 at second brackets 60 pull the center pole ribs 70 downwardly. The center pole ribs 70 further fold at joints 70A, simultaneously moving the center pole 102 downwardly. The canopy frame 100 can thus be completely collapsed. Such a collapsed configuration effectively reduces the volume and weight of the canopy frame 100 and allows a user to easily and conveniently carry the canopy frame 100.

Although the drawings and accompanying description illustrate one exemplary embodiment of a collapsible canopy frame according to the present invention, it will be apparent that the collapsible canopy frame of the present invention may also be carried out by utilizing alternative structures, sizes, shapes, and/or materials in other embodiments. For example, the side poles, center pole ribs, and scissor assemblies described above could be coupled together by any suitable coupling means, including by gluing, welding, screwing, and/or nailing.

The preceding description has been presented with reference to various embodiments of the invention. Persons skilled in the art and technology to which this invention pertains will appreciate that alterations and changes in the described structures and methods of operation can be practiced without meaningfully departing from the principles, spirit, and scope of this invention.

What is claimed is:

1. A collapsible canopy frame comprising:

a plurality of side poles;

a plurality of edge scissor assemblies coupling adjacent side poles of the plurality of side poles to one another;

a center pole for supporting a covering;

a plurality of center pole ribs each coupling an upper end of the center pole and a respective side pole of the plurality of side poles and extending linearly between the upper end of the center pole and the respective side pole when the frame is in an opened state;

a plurality of support members coupling center pole ribs of the plurality of center pole ribs to the respective side poles, the support members being coupled to the center pole ribs through respective joints that are movable along the center pole ribs; and a plurality of center scissor assemblies coupling the plurality of edge scissor assemblies to the center pole, each of the center scissor assemblies comprising a pair of scissor members that each extends from the center pole to an edge scissor assembly of the plurality of edge scissor assemblies.

2. The collapsible canopy frame of claim 1, wherein each of the side poles comprises a telescoping pole.

3. The collapsible canopy frame of claim 1, wherein each of the side poles has a fixed length.

4. The collapsible canopy frame of claim 1, wherein each of the edge scissor assemblies and the center scissor assemblies comprises two scissor members pivotably coupled together at a hinged joint.

5. The collapsible canopy frame of claim 1, wherein at least one of the plurality of center pole ribs consists of a single rib.

6. The collapsible canopy frame of claim 1, wherein each of the center pole ribs is collapsible.

7. The collapsible canopy frame of claim 1, wherein each of the center scissor assemblies is coupled at one end to a corresponding one of the edge scissor assemblies and to the center pole at an opposite end.

8. The collapsible canopy frame of claim 1, wherein each of the center scissor assemblies is coupled to a corresponding set of edge scissor assemblies of the plurality of edge scissor assemblies near a midpoint of the corresponding set of edge scissor assemblies.

9. The collapsible canopy frame of claim 8, wherein the set of edge scissor assemblies comprises at least two edge scissor assemblies of the plurality of edge scissor assemblies coupled to each other.

10. The collapsible canopy frame of claim 1, further comprising a plurality of first brackets coupling the center pole ribs to respective side poles of the plurality of side poles.

11. The collapsible canopy frame of claim 1, further comprising a plurality of first brackets and a plurality of second brackets, wherein each of the first brackets is coupled to a respective one of the side poles near a top end of the side pole and each of the second brackets is positioned on a corresponding one of the side poles below the first bracket.

12. The collapsible canopy frame of claim 11, wherein each of the first brackets is fixed to the respective one of the side poles.

13. The collapsible canopy frame of claim 11, wherein each of the second brackets is slidable along the respective one of the side poles.

14. The collapsible canopy frame of claim 11, wherein each support member of the plurality of support members is coupled to a respective side pole of the plurality of side poles through one of the second brackets.

15. The collapsible canopy frame of claim 14, wherein each of the support members is coupled to move with a corresponding one of the second brackets relative to the respective side pole.

16. A collapsible canopy frame comprising:

a plurality of side poles;

a plurality of edge scissor assemblies coupling adjacent side poles of the plurality of side poles to one another;

a center pole for supporting a covering;

a plurality of center pole ribs each coupling an upper end of the center pole and a respective side pole of the plurality of side poles and extending linearly between the upper end of the center pole and the respective side pole when the frame is in an opened state;

a plurality of support members coupling center pole ribs of the plurality of center pole ribs to the respective side poles, the support members being coupled to the center pole ribs through respective joints that are movable along the center pole ribs;

a plurality of center scissor assemblies coupling the plurality of edge scissor assemblies to the center pole;

a first hub near the upper end of the center pole and coupling the plurality of center pole ribs to the center pole;

a second hub coupling a plurality of first scissor members of the plurality of center scissor assemblies to the center pole; and a third hub between the first hub and the second hub and coupling a plurality of second scissor members of the plurality of center scissor assemblies to the center pole, the third hub slidable along the center pole.

* * * * *